United States Patent [19]

Hutchison

[11] 4,164,825

[45] Aug. 21, 1979

[54] DEVICE FOR REDUCING FIREARM RECOIL

[76] Inventor: Louis C. Hutchison, 5860 W. Edna, Las Vegas, Nev. 89102

[21] Appl. No.: 898,847

[22] Filed: Apr. 21, 1978

[51] Int. Cl.[2] ..... F41C 27/00

[52] U.S. Cl. ..... 42/1 V

[58] Field of Search ..... 42/1 V

[56] References Cited

U.S. PATENT DOCUMENTS

| | | | |
|---|---|---|---|
| 3,191,330 | 6/1965 | Alsen | 42/1 |
| 3,290,815 | 12/1966 | Edwards | 42/74 |
| 3,300,889 | 1/1967 | Baker | 42/74 |
| 3,335,515 | 8/1967 | Bennett | 42/74 |
| 3,381,405 | 5/1968 | Edwards | 42/74 |
| 3,408,062 | 10/1968 | Baker | 267/1 |

*Primary Examiner*—Charles T. Jordan

*Attorney, Agent, or Firm*—Seiler & Quirk

[57] ABSTRACT

A device for reducing firearm recoil comprises a case having an elongated interior chamber therein, a piston received in the chamber, a plurality of vanes extending from the piston surface, and a liquid substantially filling the chamber. The piston is supported between front and rear return springs. The device is inserted in a gunstock, and recoil energy of the firearm, when fired, is dampened or slowed as the case and liquid are driven rearwardly against the resistance of the piston.

17 Claims, 2 Drawing Figures

DEVICE FOR REDUCING FIREARM RECOIL

BACKGROUND OF THE INVENTION

There have been proposed various recoil damping or reducing devices for firearms. Where recoil is significant, such as in relatively large bore rifles, or shotguns, and where accuracy and user comfort and convenience are of primary importance, recoil reducing means are highly desirable. Previously proposed devices, such as disclosed in U.S. Pat. Nos. 3,290,815 and 3,381,405, have incorporated pistons which react against relatively heavy springs in a counter-recoil manner, as the weapon recoils. Although some effectiveness is realized with such a device, it is not altogether satisfactory. For example, where a relatively heavy spring is used at the forward end of the device, and against which the piston is driven during gun recoil, after the heavy counter-recoil spring is compressed, it expands rapidly thereby driving the piston rearwardly to cause a reverse recoil action. The relatively large spring diameters and lengths significantly reduce effective piston travel distance, and without adequate lubrication, internal damage and wear often cause early system failure. Moreover, through continued use, the heavy counter-recoil spring will become weakened, or otherwise deteriorated, so that efficiency of the device is compromised, and replacement is eventually required. Further, the operation of such a prior device is often noisy, further distracting a user. It is to the elimination of these disadvantages that the recoil reducer of the present invention is directed.

SUMMARY OF THE INVENTION

In the subject invention, the recoil reducing device comprises a piston suspended in a closed chamber filled with a viscous liquid. The piston includes outwardly or radially extending means which resist rapid movement of the piston in the liquid, thereby achieving a significant reduction in gun recoil speed which has a damping effect for recoil reduction. More specific details of the device as well as advantages will be evident from the following detailed description.

DETAILED DESCRIPTION OF THE INVENTION

Figure 1:
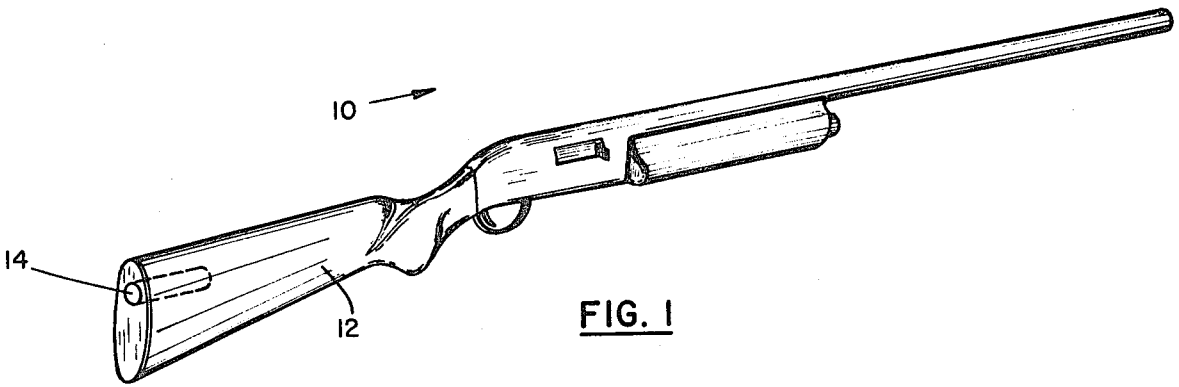
FIG. 1 illustrates a firearm, indicating placement of the recoil reducing device in the gunstock.

In FIG. 1, there is illustrated generally a shotgun or rifle 10 having a stock 12 in which a cavity 14 is drilled or otherwise formed. Conveniently, such a cavity is formed through the butt plate of the stock so that the recoil reducing device of the invention can be inserted therein. The cavity is elongated, preferably extending substantially parallel with the axis of the firearm barrel. Means for closing the cavity, once the device has been properly inserted, is obviously desirable. For example, a plug or hinged cap, under or built into a buttplate or buttpad may be used.

Figure 2:
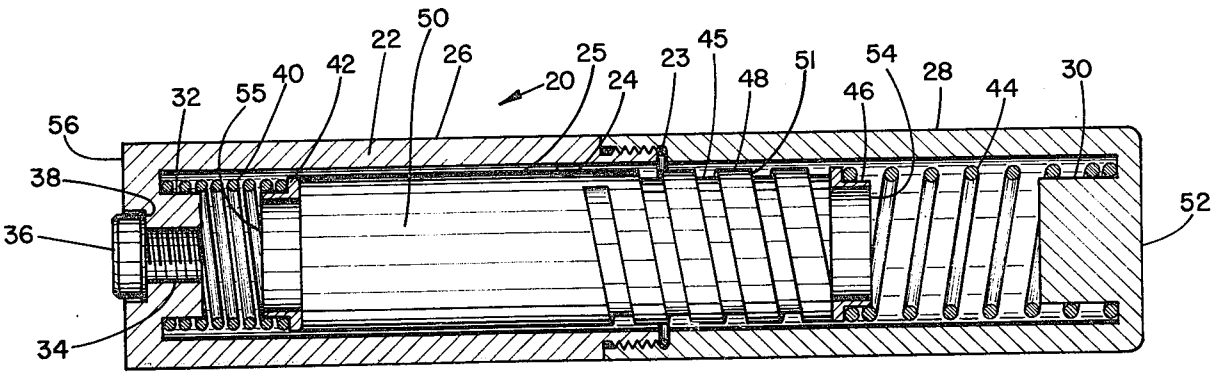
FIG. 2 is a side elevation, partially in section, of the device of the invention.

In FIG. 2 there is illustrated in detail, the recoil reducing device 20 of the invention. A case 22, preferably elongated and generally cylindrical, has a hollow interior chamber 25 defined within interior case wall 24. A piston 50 is located within interior chamber 25, supported between reset spring 44, located forwardly in the chamber, and reset damper spring 40, located behind or rearwardly of the piston. In the preferred embodiment, the case includes a front and rear spring holding lug 30 and 32, respectively, to which the respective reset and reset damper springs are secured. However, other means for attaching or securing the springs maybe incorporated. At the forward end of piston 50 is a boss 54, around which is located a friction sleeve bearing 46, shown in section. Similarly, a rear boss 55 projects from the piston, and around which is secured a friction bearing sleeve 42. The purpose for these sleeves is to provide a seat for the spring, and allow for rotational movement of the piston, without interferring with the reset and reset damping springs. Accordingly, each of those springs is also secured around one of the friction bearing sleeves, so that the piston can rotate axially within the sleeves, without causing significant rotational torque or force against the respective springs. The elimination of such spring rotation further prevents or reduces spring and case wear on their contacting surface at the front case end. To provide for such rotational piston movement, bosses 54 and 55 have a substantially circular exterior surface, as do the interior bearing surfaces, the latter being slightly enlarged, so as not to restrict piston rotation. Moreover, the bearings prevent piston wear where steel springs are used with relatively soft piston materials such as lead.

Piston 50 is shown having an exterior surface 45, and extending outwardly therefrom are means for resisting piston movement relative to the case. Understanding that the interior chamber 25 of the case is filled with a viscous liquid, such movement resistance means comprises a radially or outwardly extending member or plurality of members which induce a "drag" effect, i.e. slows movement, of the piston through the liquid. In the preferred embodiment illustrated, such a means comprises a helical band 48 extending along the length of the piston and radially therefrom. The continuous helical band has a forward surface 51 which is forced against the liquid when the case and liquid are driven rearwardly during firearm recoil. The outer helical band surface may be flat, as shown, and is spaced apart from the interior case wall 24, so that piston movement relative to the case is unrestricted along the interior case sides. The band is shown extending along only a portion of the piston length, but it may be further extended, if desired.

The case 22 is conveniently made from a forward case portion 28, and rearward case portion 26, each having a threaded surface so that the portions can be threadedly engaged. A sealing ring 23, such as neopreme, or other elastomer, for sealing the engaged case portions from possible leakage of liquid is preferably used. Such a construction offers the advantage of access to the interior of the device by simply disengaging the two case portions. For example, the exchange of interior components to accommodate change of powder charges, projectiles, or for different sized (caliber or gauge) guns, may be desireable. At the rear end of the device is conveniently located a port 34, for inspection, replenishment, or replacement of the viscous liquid. The plug for closing the port in the form of a cap screw 36 and washer 38, threadedly engaging mating port surfaces, is also preferred.

The use of a viscous liquid to fill the interior case chamber achieves a number of advantages over prior recoil reducer devices. Specifically, the liquid resists rapid piston movement, thereby eliminating the need for long, heavy springs and thus allowing more space for greater piston travel. The liquid also lubricates to substantially reduce any friction wear. Yet another advantage is in dampening the distracting noise normally existing in previous dry systems. Any suitable viscous liquid may be used, having a viscosity greater than water, i.e., above 10 millipoise at 20° C. Preferred liquids are premium grade hydraulic oils, such as petroleum or hydrocarbon based oils, or synthetic oils including silicone oils, siloxanes, or other viscous synthetics, of S.A.E. weights of between about 5 and 10, or multiviscosity ratings. In general, the greater the viscosity, the greater will be damping or recoil reduction and energy absorbsion of the device, due to the increased resistance to relative movement of the case and piston. An especially preferred liquid is Enerpac, a premium grade hydraulic oil having a viscosity at 100° F. of F150.0 and a pour point of −25° F. However, such an oil is by way of example only, and the invention is not to be so limited.

In using the device, the forward end 52 is inserted into a cavity 14 in a gun or rifle stock 12. The size of the cavity is only critical, in that it should be sufficient to allow easy placement of the cylindrical device therein, and be readily recovered. If the diameter of the cavity is sufficiently large, some packing material between the exterior case surface and the cavity may be desired. Wrapping the case with plastic or masking tape is useful for that purpose. Since the purpose of the device is to provide substantial firearm recoil reduction, the relative position of the piston, at rest in the case, is that illustrated in FIG. 2. Thus, the piston, at rest, is located closer to the rear case end, and reset spring 44 is longer than reset damper spring 40. The greater distance between the forward interior case and piston ends provides the greatest distance for relative movement of the case and piston during firearm recoil. With the device of the invention so placed in the gun or rifle stock, as the gun is fired, it recoils rearwardly, driving the stock into or against the shoulder of the user, as normally held. As this occurs, case 22 is driven rearwardly, while suspended piston 50 is stationary, for a short period of time, thereby causing it to be urged against the viscous liquid. It is this inertial force of the liquid rearwardly against the momentarily stationary piston that provides the energy absorbing and damping effect of the device.

Especially advantageous is the outwardly or radially extending means from the piston, against which the liquid is forced. Such an effect allows for the use of a somewhat lighter piston, as well as a shorter relative case and piston movement, to achieve a greater recoil damping effect. Moreover, where such a movement means is in the form of a helical band illustrated, the force of the liquid against the forward band surface 51 causes the piston to rotate during weapon recoil, which rotational force is advantageous for countering any weapon twist which may be experienced in rifle recoil. Thus, where such an effect is desirable, the direction of the helical pattern on the piston will be formed to take advantage of such piston rotation. For example, the right handed thread in the helical pattern is beneficial for right handed shooters, and a left handed thread or twist, for left handers. The radially extending means may be in the form of arms, vanes, bands, and the like, preferably having a forward surface extending normal, or nearly so, to the piston surface. An even greater effect may be realized where the forward surface of the arms or bands forms an acute angle with the piston surface.

Although reset spring 44 will offer some resistance to rearward movement of the case relative to the piston, during weapon recoil, its major purpose is to return the piston to its rearward rest position in the case. Accordingly, the spring need not be extensively heavy or stiff, since again, recoil damping is not its primary purpose. Similarly, the reset damper spring 40 is for maintaining suspension of the rear end of the piston relative to the hollow case interior. It will be understood that other radially extending means from the piston surface may be used to achieve the desired damping, including a plurality of rings, projections, protrubences and the like. The specific design is not particularly critical, so long as the desired damping effect is achieved. For example, a plurality of rings, spaced along the piston exterior rather than in the helical fashion shown, may be used where piston rotation is not required or desired. Other forms of such means may be used to achieve the same purposes.

Other modifications to the device such as an enlarged cap at the rear end of the case, for both replenishing liquid and removing interior components for repair or replacement may be used. Thus, the specific construction of the case, including its interior and exterior shape and design, ports, and other access features for the components may be modified to achieve the same purpose within the purview of the invention disclosed herein. Because of its construction, the device of the invention offers improvements and advantages over previously proposed recoil reducers, not only in improved damping capacity, and noise abatement but in reducing, if not eliminating, undesirable reverse recoil, from reverse piston thrust caused by damping spring expansion. Other advantages may be evident to those skilled in the art.

I claim:

1. A firearm recoil reducing device comprising
a case enclosing an elongated interior chamber,
a piston received in said chamber having a plurality of vanes along the exterior surface thereof and supported between a front and a rear spring, and
a liquid substantially filling said chamber.

2. The device of claim 1 wherein said case has an interior cylindrical surface having a substantially uniform diameter along its length and defining said interior chamber.

3. The device of claim 2 wherein said piston is elongated, and wherein said plurality of vanes comprise a helical band.

4. The device of claim 3 wherein the band and interior cylindrical surfaces are spaced apart.

5. The device of claim 4 wherein the band has an outer surface spaced uniformly from said interior cylindrical surface.

6. The device of claim 5 wherein the liquid has a viscosity of greater than 10 millipoises at 20° C.

7. The device of claim 1 including means for securing the front and rear springs at front and rear ends of the interior chamber, respectively.

8. The device of claim 7 wherein the distance between the piston and the front interior end is greater than the distance between the piston and the rear interior end.

9. The device of claim 1 including a port in the case communicating with said chamber, and a plug for said port.

10. A device for damping firearm recoil comprising:
a case having a chamber therein,
a liquid substantially filling said chamber,
a piston spaced apart from chamber walls and moveably received in said chamber having one or more members extending outwardly from a piston surface for resisting piston movement in said liquid, and biasing means for returning said piston to a rest position after firearm recoil.

11. The device of claim 10 wherein said chamber and said piston are elongated, each having a front and rear end, and wherein said biasing means comprises first and second springs, said first spring extending between the front ends of said piston and said chamber, and said second spring extending between the rear ends of said piston and said chamber.

12. The device of claims 10 or 11 wherein the member extending outwardly comprises a rib extending helically along said piston surface.

13. The device of claims 10 or 11 wherein said liquid has a viscosity greater than water.

14. The device of claims 10 or 11 wherein said liquid comprises a viscous oil.

15. The device of claims 10 or 11 wherein the one or more members have a forward surface extending normal to the piston surface.

16. The device of claim 11 including friction bearing means on which said springs are secured at the front and rear ends of said piston.

17. The device of claim 16 wherein said friction bearing means comprises a first and second sleeve rotatably mounted on the front and rear ends of said piston, respectively.

* * * * *